US008246479B2

(12) United States Patent
Tirelli

(10) Patent No.: US 8,246,479 B2
(45) Date of Patent: Aug. 21, 2012

(54) MECHANICAL DEVICE FOR SIMULATING AN ANIMAL RIDE

(76) Inventor: Roland Tirelli, Simi Valley, CA (US)

( * ) Notice: Subject to any disclaimer, the term of this patent is extended or adjusted under 35 U.S.C. 154(b) by 0 days.

(21) Appl. No.: 13/186,261

(22) Filed: Jul. 19, 2011

(65) Prior Publication Data

US 2011/0275444 A1 Nov. 10, 2011

Related U.S. Application Data

(63) Continuation-in-part of application No. 12/574,367, filed on Oct. 6, 2009, now Pat. No. 8,047,924.

(60) Provisional application No. 61/137,824, filed on Oct. 27, 2008.

(51) Int. Cl.
*A63G 13/06* (2006.01)
*A63G 13/00* (2006.01)

(52) U.S. Cl. ..... 472/96; 472/59; 434/247

(58) Field of Classification Search ..... 472/43, 472/59, 95–97, 99–100, 130, 131, 135; 434/29, 434/55, 247, 256
See application file for complete search history.

(56) References Cited

U.S. PATENT DOCUMENTS

| | | | |
|---|---|---|---|
| 3,997,157 | A | 12/1976 | Meyer |
| 3,997,979 | A | 12/1976 | Turner |
| 4,988,300 | A | 1/1991 | Yamaguchi et al. |
| 5,531,644 | A | 7/1996 | Marumo |
| 5,584,696 | A | 12/1996 | Walker et al. |
| 5,623,878 | A | 4/1997 | Baxter et al. |
| 5,716,281 | A | 2/1998 | Dote |
| 5,848,939 | A | 12/1998 | Smith |
| 5,865,624 | A | 2/1999 | Hayashigawa |
| 6,095,819 | A | 8/2000 | Ferrand et al. |
| 6,124,862 | A | 9/2000 | Boyken et al. |
| 6,210,286 | B1 | 4/2001 | Ohara et al. |
| 6,224,491 | B1 | 5/2001 | Hiromi et al. |
| 6,347,999 | B1 | 2/2002 | Yuan |
| 7,691,002 | B2 | 4/2010 | Casey et al. |
| 2006/0287137 | A1 | 12/2006 | Chu |
| 2007/0178973 | A1 | 8/2007 | Camhi |
| 2007/0287139 | A1 | 12/2007 | Holm |

FOREIGN PATENT DOCUMENTS

| | | | |
|---|---|---|---|
| EP | 1510236 | A1 | 3/2005 |
| WO | WO01/89649 | A1 | 11/2001 |

*Primary Examiner* — Kien Nguyen
(74) *Attorney, Agent, or Firm* — Marc E. Hankin; Kevin Schraven; Hankin Patent Law, APC

(57) ABSTRACT

The present invention is a mechanical ride that simulates riding an actual rodeo bull. simulator, which provides a rider a simulation of an rodeo bull ride. The ride includes a track, a sled to move the ride along the track, and a mechanical body affixed to the sled. The mechanical body includes a plurality of actuators and motors that simulate the bucking, rotating, lunging, pitching, and tilting movement of an actual rodeo bull. The simulated movements are performed at the same time as the ride moving along the track.

14 Claims, 8 Drawing Sheets

MECHANICAL DEVICE FOR SIMULATING AN ANIMAL RIDE

This application is a Continuation-in-Part of U.S. Non-Provisional patent application Ser. No. 12/574,367, filed on Oct. 6, 2009, now U.S. Pat. No. 8,047,924, titled "Riding Simulation System", by inventor Roland Tirelli, the contents of which are expressly incorporated herein by this reference, and to which priority is claimed. Priority is also claimed to U.S. Provisional Patent Application Ser. No. 61/137,824 filed Oct. 27, 2008, titled "BullVicious, the bull riders experience", by inventor Roland Tirelli, the contents of which are expressly incorporated herein by this reference.

FIELD OF THE INVENTION

The invention is a device for simulating an animal ride. More particularly, the invention is a device for simulating a bull ride experience, wherein the rider and mechanical bull, move along a track.

BACKGROUND OF THE INVENTION

Mechanical bulls have existed as part of the American culture for decades, primarily for entertainment found in amusement parks, bars, restaurants, and clubs. These mechanical bulls have always been stationed at fixed locations and have provided amateurs and enthusiasts an opportunity to experience the sensation of riding a rodeo bull. The rider mounts herself onto the saddle of a traditional mechanical bull, holds onto the handle, and attempts to stay on the mechanical bull, as it replicates the movements of a bucking animal. As the bull "bucks" up and down, the rider attempts to hang on tightly. In these circumstances, the rider is judged by his/her ability to remain on the mechanical bull during for a predetermined period of time. It is generally expected that the mechanical bull may buck the rider off, which is why the stationary mechanical bull frequently has pads placed around it to soften the landing for the ejected passenger.

Although traditional mechanical bulls exhibit bucking movements vaguely similar to an actual rodeo bull, none have been able to impart a greater sense of realism due, in part, to its failure of replicating additional movements inherent to a live bull. For example, most mechanical bulls include "up" and "down" bucking movements, but they do not include other movements such as "pitching" and "lunging." Additionally, before the present invention, mechanical bull rides have not included such movements as leg movements and head turning. Indeed, because currently available mechanical bulls lack motorized legs and head, these simulated bull rides are severely limited in conveying a sense of realism.

Furthermore, before the present invention, mechanical bull rides were always in a fixed location. This fixed location design is a significant limitation and it prevents riders from experiencing the sensation of moving spatially as s/he experiences the bucking movements of the mechanical bull. As such, a bull rodeo simulator that moves a rider freely rather than a fixed location would provide a rider a more realistic sensation of a rodeo bull riding experience.

U.S. Pat. No. 3,997,979 issued to Turner, for example, discloses a rodeo training device for training cowboys to ride rodeo animals such as bulls and wild horses. The apparatus includes only a rider support and mechanism to drive the support to simulate bucking and spinning motions of a rodeo animal. While this is helpful, it does not provide spatial movements, as it is stationed in a fixed location. Additionally, it does not provide realistic animal characteristics such leg movement, lunging, and head turning.

Therefore, what is needed is an improved mechanical animal simulation device that provides enthusiasts a more realistic simulation of an actual bucking animal ride by: (1) moving both the mechanical animal and rider spatially; (2) replicating more realistic bucking movements by moving one or more motorized parts of the mechanical animal; and (3) providing a mechanical animal that has realistic animal characteristics, including leg movement, lunging, and head turning.

SUMMARY OF THE INVENTION

To minimize the limitations in the prior art, and to minimize other limitations that will become apparent upon reading and understanding the present specification, the present invention is a ride that simulates riding a rodeo bull or any other type of animal.

One embodiment of the invention is a mechanical device for simulating an animal ride, comprising: a track; a sled; a support mount; a mechanical body, wherein the mechanical body is comprised of one or more actuators; and one or more controllers. The sled is movably connected to the track. The support mount is attached to the sled, such that the support mount rises upward from a top portion of the sled. The mechanical body is connected to the support mount, such that the mechanical body is positioned above the sled. The mechanical body is designed to be mounted by a rider. The controllers communicate electrical signals to the actuators to cause the actuators to simulate one or more movements of an animal. The sled moves along the track when the actuators simulate the one or more movements of the animal. Preferably, the support mount is rotatable with respect to the sled. Preferably, the mechanical body anatomically simulates the animal. Typically, the mechanical body is further comprised of an outer skin layer, which causes the mechanical body to visually resemble the animal. The sled may be further comprised of a plurality of wheels. The wheels preferably matingly engage with the track and also move the sled along the track. The sled may be further comprised of a rotational actuator that rotates the support mount with respect to the sled. Preferably, the mechanical body is further comprised of a head portion, a trunk portion, and one or more leg portions. The head portion and the one or more leg portions are preferably movably connected to the trunk portion. The actuators are preferably comprised of one or more neck tilt actuators, which may be connected to the trunk portion and the head portion and which move the head portion up and down with respect to the trunk portion. The actuators are preferably further comprised of one or more head turn actuators. The head turn actuators are located in the head portion and they move the head portion back and forth. Preferably, the one or more actuators are comprised of one or more leg actuators. The leg actuators may be connected to the trunk portion and the one or more leg portions, and the leg actuators may pivot the leg portions back and forth with respect to the trunk portion. The actuators are preferably further comprised of one or more body pitch actuators and one or more lunge actuators. The body pitch actuators are typically located substantially near a center of the mechanical body and provide one or more pitching movements of the mechanical body. The lunge actuators are preferably located adjacent to a rear side of the support mount and provide one or more lunging movements of the mechanical body. The mechanical device for simulating an animal ride may further comprise a safety harness. The safety harness prevents the rider from being thrown or bucked off of the mechanical body. The safety harness may be comprised of a safety vest that is connected to the mechanical body.

Another embodiment of the invention is a mechanical device for simulating a rodeo bull ride, comprising: a track; a wheeled sled; a support mount; a mechanical body, wherein the mechanical body is comprised of one or more actuators, an out skin layer, a head portion, a trunk portion, and one or more leg portions. The wheeled sled is movably connected to the track such that the sled moves along a length of the track. The support mount is attached to the sled, such that the support mount rises upward from a top portion of the sled. The mechanical body is connected to the support mount, such that the mechanical body is positioned above the sled. The actuators simulate one or more movements of a rodeo bull. The sled moves along the track when the actuators simulate the one or more movements of the rodeo bull, thus simulating a bull ride. The sled is further comprised of a rotational actuator that rotates the support mount with respect to the sled. The mechanical body anatomically simulates the rodeo bull. The outer skin layer causes the mechanical body to visually resemble the rodeo bull. The head portion and the one or more leg portions are moveably connected to the trunk portion. The actuators are comprised of one or more neck tilt actuators, one or more head turn actuators, one or more leg actuators, one or more body pitch actuators, and one or more lunge actuators. The neck tilt actuators are connected to the trunk portion and the head portion. The neck tilt actuators move the head portion up and down with respect to the trunk portion. The head turn actuators are located on the head portion. The head turn actuators move the head portion back and forth. The leg actuators are connected to the trunk portion. The leg actuators pivot the one or more leg portions back and forth with respect to the trunk portion. The body pitch actuators are located substantially near a center of the mechanical body and provide one or more pitching movements of the mechanical body. The lunge actuators are located adjacent to a rear side of the support mount and provide one or more lunging movements of the mechanical body.

Another embodiment of the invention may include a wheeled base that is further comprised of a cable return system that reels and imparts cables communicating to the one or more actuators of the rodeo simulator as the mechanical body moves along the track.

Another embodiment of the invention may include one or more sensors at the end of the track configured to provide emergency signals that would stop the movements of the mechanical body.

It is an object of the invention to provide an improved simulated bull ride wherein the mechanical bull moves spatially along a guided track while at the same time the mechanical body of the bull is bucking, pitching, lunging, and rotating.

It is an object of the invention to provide a more realistic bull riding simulation wherein the mechanical bull provides realistic bodily movements.

It is an object of the invention to provide an efficient, easy to set up, portable, simulated bull ride wherein the user experiences a realistic simulated bull ride.

It is an object of the invention to provide a safe bull ride simulation wherein the track runs under a platform that protects the rider from touching the track or slide. The ride may also have sensors to stop the mechanical bull upon the end of the track.

It is an object of the present invention to overcome the limitations of the prior art.

These, as well as other components, features, objects, benefits, and advantages, will now become clear from a review of the following detailed description of illustrative embodiments, the accompanying drawings, and the claims.

BRIEF DESCRIPTION OF THE DRAWINGS

The drawings are illustrative embodiments. They do not illustrate all embodiments. Other embodiments may be used in addition or instead. Details which may be apparent or unnecessary may be omitted to save space or for more effective illustration. Some embodiments may be practiced with additional components or steps and/or without all of the components or steps which are illustrated. When the same numeral appears in different drawings, it refers to the same or like components or steps.

DETAILED DESCRIPTION OF THE DRAWINGS

In the following detailed description of various embodiments of the invention, numerous specific details are set forth in order to provide a thorough understanding of various aspects of one or more embodiments of the invention. However, one or more embodiments of the invention may be practiced without some or all of these specific details. In other instances, well-known methods, procedures, and/or components have not been described in detail so as not to unnecessarily obscure aspects of embodiments of the invention.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the screen shot figures, and the detailed descriptions thereof, are to be regarded as illustrative in nature and not restrictive. Also, the reference or non-reference to a particular embodiment of the invention shall not be interpreted to limit the scope of the invention.

Figure 1:
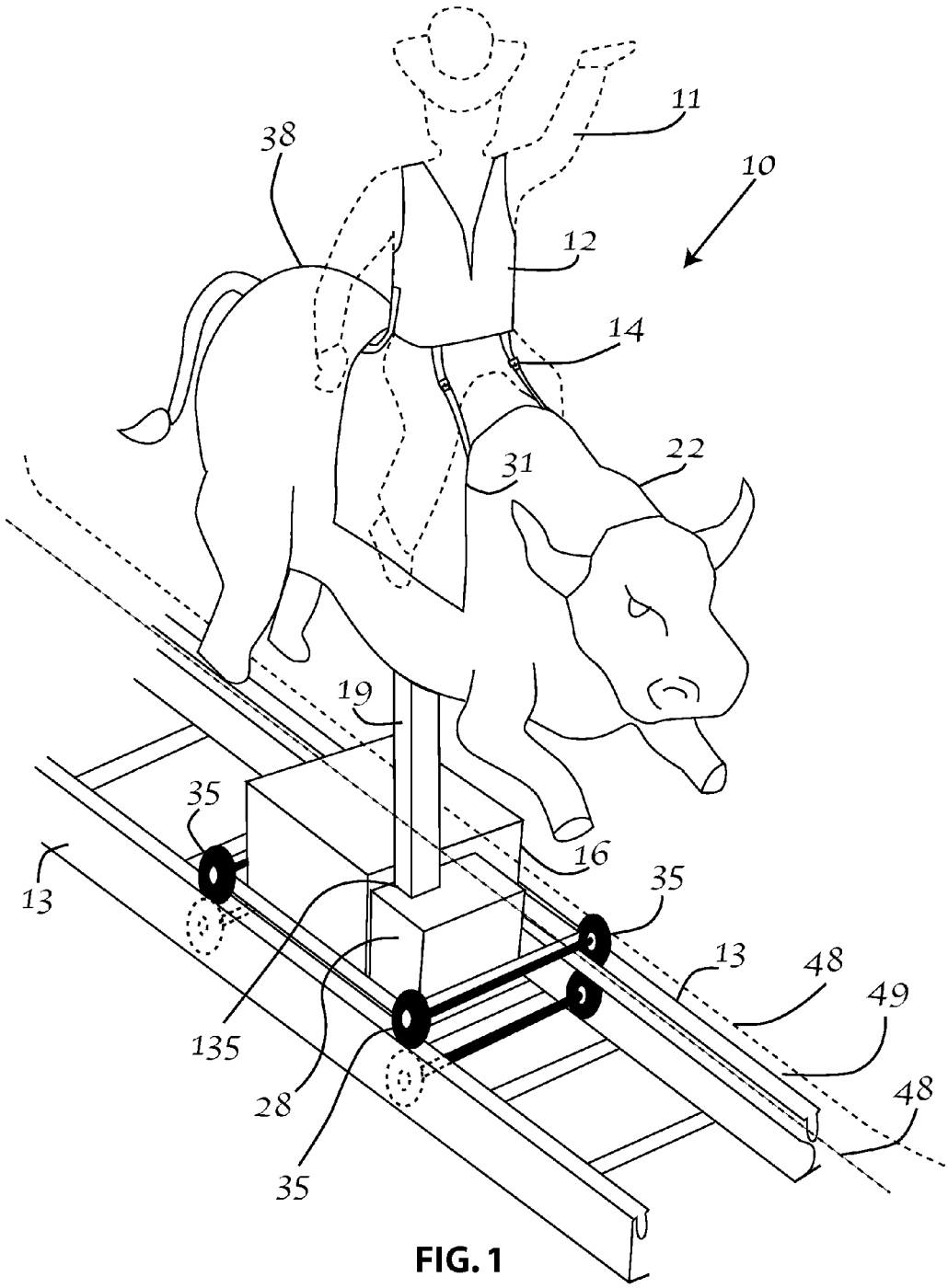
FIG. 1 is a perspective view of one embodiment of the mechanical animal ride and shows the ride in use by a rider.

FIG. 1 is a perspective view of one embodiment of the mechanical animal ride and shows the ride in use by a rider. As shown in FIG. 1, the mechanical device for simulating an animal ride 10, which is also referred to as the mechanical animal ride or rodeo simulator, preferably includes a track 13, wheeled base or sled 16, rotation actuator 135, support mount 19, mechanical body 22, one or more actuators (shown in FIGS. 2 to 8), and an electronic controller 28 (also shown in FIG. 7). The animal ride 10 may also include platform 48, which has a gap 49. The platform 48 keeps the rider from getting injured by the sled 10 as the sled 10 moves along the track 13. The sled 16 is usually a wheeled base that is moveably coupled to the track 13 and typically includes a plurality of wheels 35 adapted to move the wheeled base or sled 16 along the track 13. However, any type of moveable base, or sled device may be used to carry the bull ride along the track, including, but not limited to: monorail, side wheel, or a magnetic sled or other type of levitation device, without deviating from the scope of the invention. The wheeled base or sled 16 may include the electronic controller 28 (the block diagram of the electronic controller 28 is also shown in FIG. 7) that communicates electrical signals to the one or more actuators to provide movement of one or more parts of the mechanical body 22. While the electronic controller 28 may be included in the wheeled base or sled 16, the electronic controller 28 may be located anywhere in the present invention, or, as preferred, remotely, without deviating from the scope of the invention.

FIG. 1 shows that the support mount 19 attaches to the wheeled base or sled 16 and is typically positioned so that the support mount 19 extends above sled 16. Although FIG. 1 shows that there is a single support mount 19, it should be understood that any number of support mounts may be used without deviating from the scope of the invention. Furthermore, the mechanical body 22 is movably connected to and, typically, positioned at the top end of the support mount 19. However, the mechanical body 22 may be positioned anywhere along the support mount 19 without deviating from the scope of the invention. The support mount 19 is preferably rotatably connected to the sled 16. The rotation of the support mount 19 is preferably accomplished by rotation actuator 18. The rotation actuator 18 may rotate the support mount 19 in either direction. The rotation actuator 18 simulates the spinning or twisting movements of a rodeo bull.

The mechanical body 22 preferably includes an outer skin layer 38 and may include a seat mount structure 31, which is typically mounted on the mechanical body 22. The outer skin layer 38 preferably allows the mechanical body 22 to mimic and anatomically resemble a real animal. FIG. 1 shows that the outer skin layer 38 allows the mechanical body 22 to resemble a bull. However, the mechanical body 22 may be made to any resemble any form or animal, such as a horse or donkey, without deviating from the scope of the invention.

The present invention is preferably constructed out of high strength materials, such as steel or other metals and high impact plastic, but any natural or manmade material may be used without deviating from the scope of the invention.

FIG. 1 also shows how the ride 10 is mounted by a rider 11. The rider 11 is preferably wearing a safety harness 12 that prevents the rider 11 from being thrown from the ride 10 so that the rider may safely experience the ride 10. FIG. 1 shows that the safety harness 12 is preferably a vest that is worn by rider 11 and that is coupled to the mechanical body 22 via harness connections 14. Harness connections 14 are preferably quick release buckles or fasteners.

Figure 2:
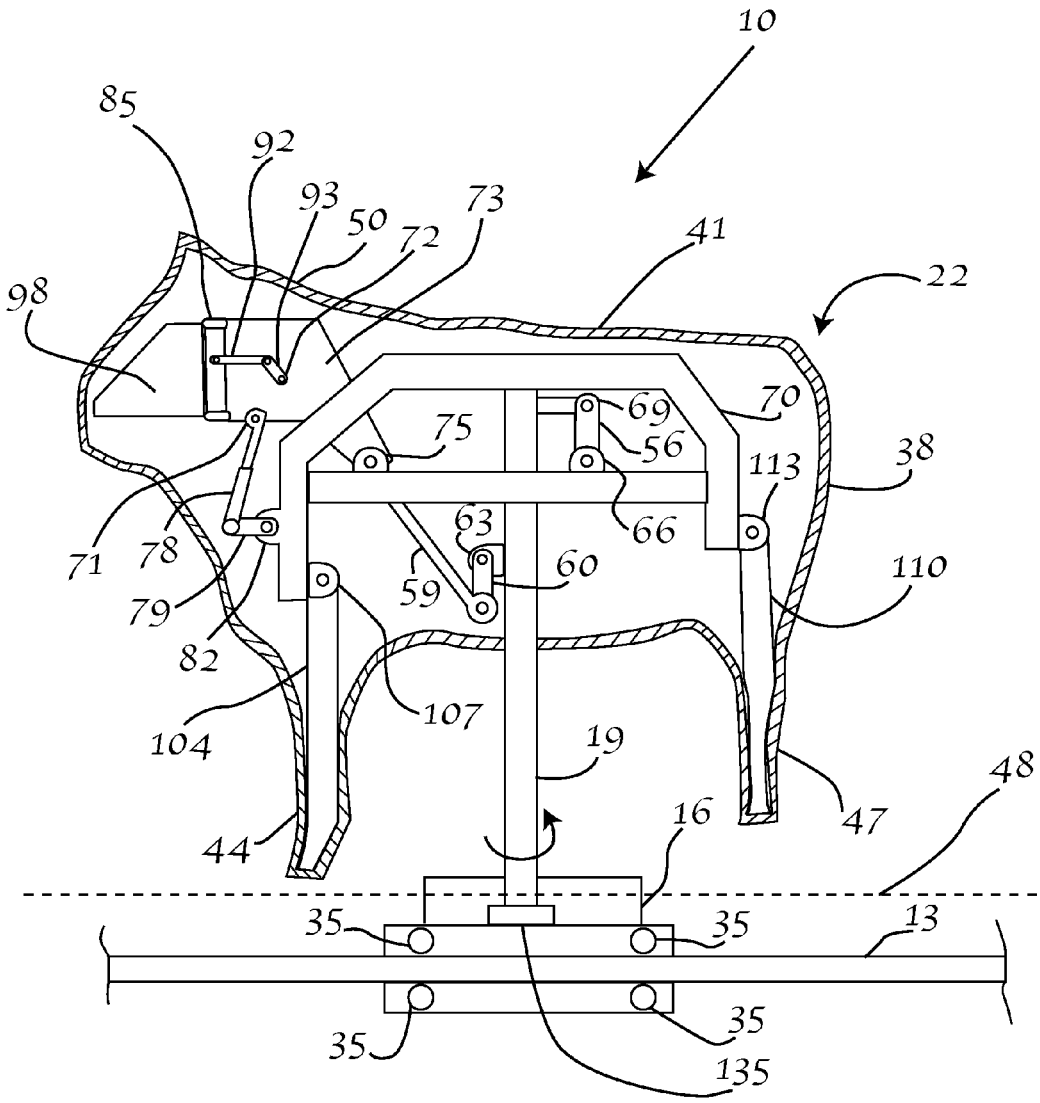
FIG. 2 is a cross-sectional view of one embodiment of the mechanical animal ride of the rodeo simulator.

FIG. 2 is a cross-sectional view of one embodiment of the mechanical animal ride. As shown in FIG. 2, the mechanical device for simulating an animal ride 10, includes track 13, sled or wheeled base 16, a support mount 19, and a mechanical body 22. The mechanical body 22, as shown in FIG. 2, preferably includes the outer skin layer 38, body portion 41, front leg portions 44, rear leg portions 47, head portion 50. The body portion 41 preferably includes a lunge armature 56, drive pitch armatures 59, 60, body pitch actuator 63, lunge rotation point 66, body lunge actuator 69, and body frame 70.

The body portion 41, which is preferably attached to the outer skin layer 38, is positioned substantially at the center of the mechanical body 22 and is preferably attached at the upper end of support mount 19.

FIG. 2 shows how the head portion 50 is attached to body portion 41 at head portion pivot point 75 and neck tilt actuator 82. The neck tilt mechanism preferably includes neck tilt armatures 78, 79, neck tilt head connection pivot 71 and neck tilt actuator 82.

As shown in FIG. 2, the head portion 50 typically includes neck 73, head portion pivot point 75, head 98, head turn pivot 85, head turn actuator 72, and head turn armatures 92 and 93. The head turn actuator 72 rotates, which causes head turn armatures to shift or shake the head 98 back and forth or left and right, with respect to neck 73 at head turn pivot 85.

FIG. 2 shows that the leg portions preferably include two front legs 44 and two rear legs 47. The leg portions preferably include front leg armatures 104 and front leg actuators 107. Front leg actuators 107, in addition to moving the front leg armatures 104, also act as the connection point between the front leg portion and the body portion 41. The rear legs 47 preferably include rear leg armatures 110 and back leg actuators 113. Rear leg actuators 113, in addition to moving the rear leg armatures 110, also act as the connection point between the rear leg portion and the body portion 41.

The body, head, and leg frames, rods, and armatures are typically made out of steel, but any natural or manmade material may be used without deviating from the scope of the invention. The actuators are motor or pneumatic driven actuators that are known in the art. The actuators preferably include a wheel, axle, and motor device, but may include additional components as may be required. The one or more actuators receive electrical input signals, but may receive any other forms of input signals. The pivots of the present invention are known in the art and generally comprised of an axle and lever, but any additional components may be used. The pivots are preferably made out of metal, but any type of material may be used.

FIG. 2 also shows how the track 13 is preferably below platform 48 and the mechanical body 22 is above platform 48.

Figure 3:
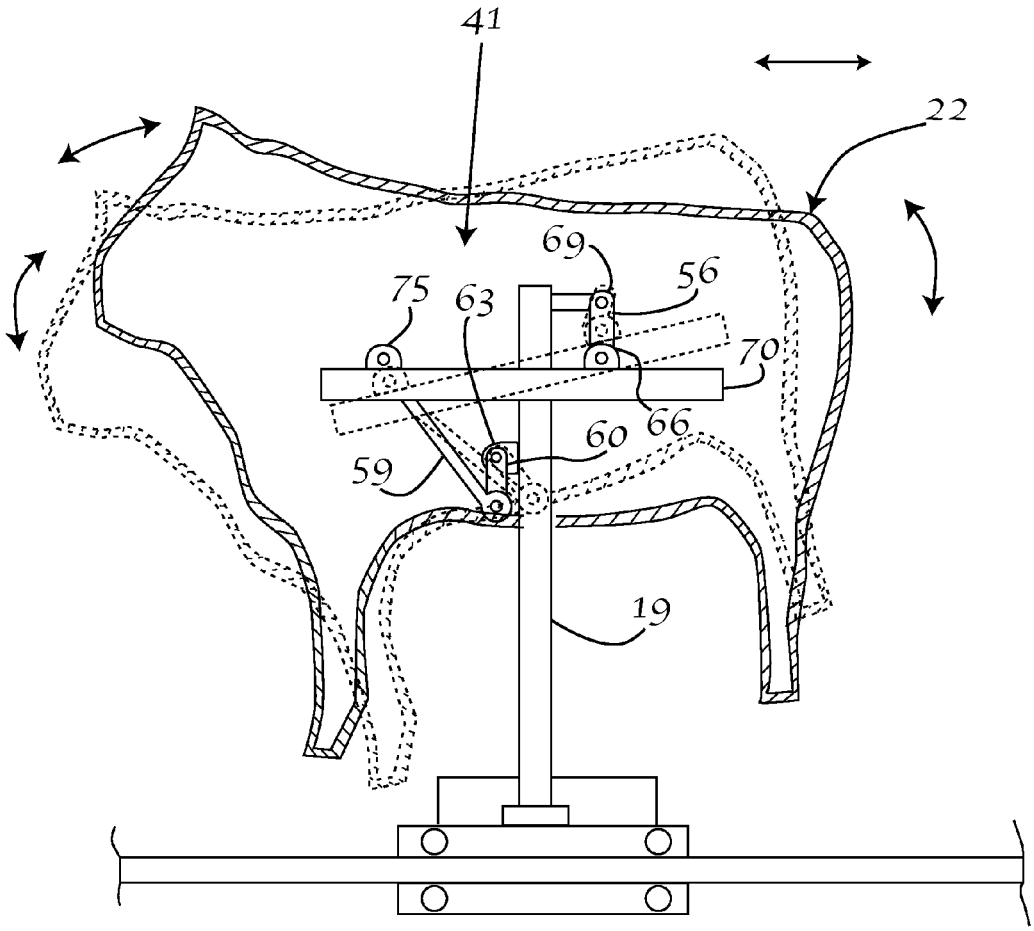
FIG. 3 is a cross-sectional view of one embodiment of the mechanical animal ride and shows the ride pitching and lunging.

FIG. 3 is a cross-sectional view of one embodiment of the mechanical animal ride and shows the ride pitching and lunging. As shown in FIG. 3, the body portion 41 preferably includes a lunge armature 56, drive pitch armatures 59, 60, body pitch actuator 63, lunge rotation point 66, body lunge actuator 69, and body frame 70. FIG. 3 shows that body pitch actuator 63 and body lunge actuator 69 preferably rotate, which in turn causes the drive pitch armatures 59, 60, lunge armature 56, and body frame 70 to move in response to the rotation. These movements are translated into pitching and lunging movements that move the mechanical body 22 in a realistic bucking motion. The dashed lines in FIG. 3 show a small portion of the potential horizontal and vertical movement capable by the mechanical body 22 as a result of the actuators moving.

The body lunge actuator 69 and body pitch actuator 63 may move in a counterclockwise or clockwise direction. The movements shown in FIG. 3 illustrate a new technique of pitching and lunging that have never been practiced before the present invention. The body lunge actuator 69 and body pitch actuator 63 may rotate in the same or opposite directions and may rotate and identical or different speeds. This results in a synergistic and previously-unpredictable lunging and pitching, which simulates the unpredictable movements of a bull. The rotary movements of the body pitch actuator 63 and body lunge actuator 69 are typically controlled by the electronic controller 28.

Figure 4:
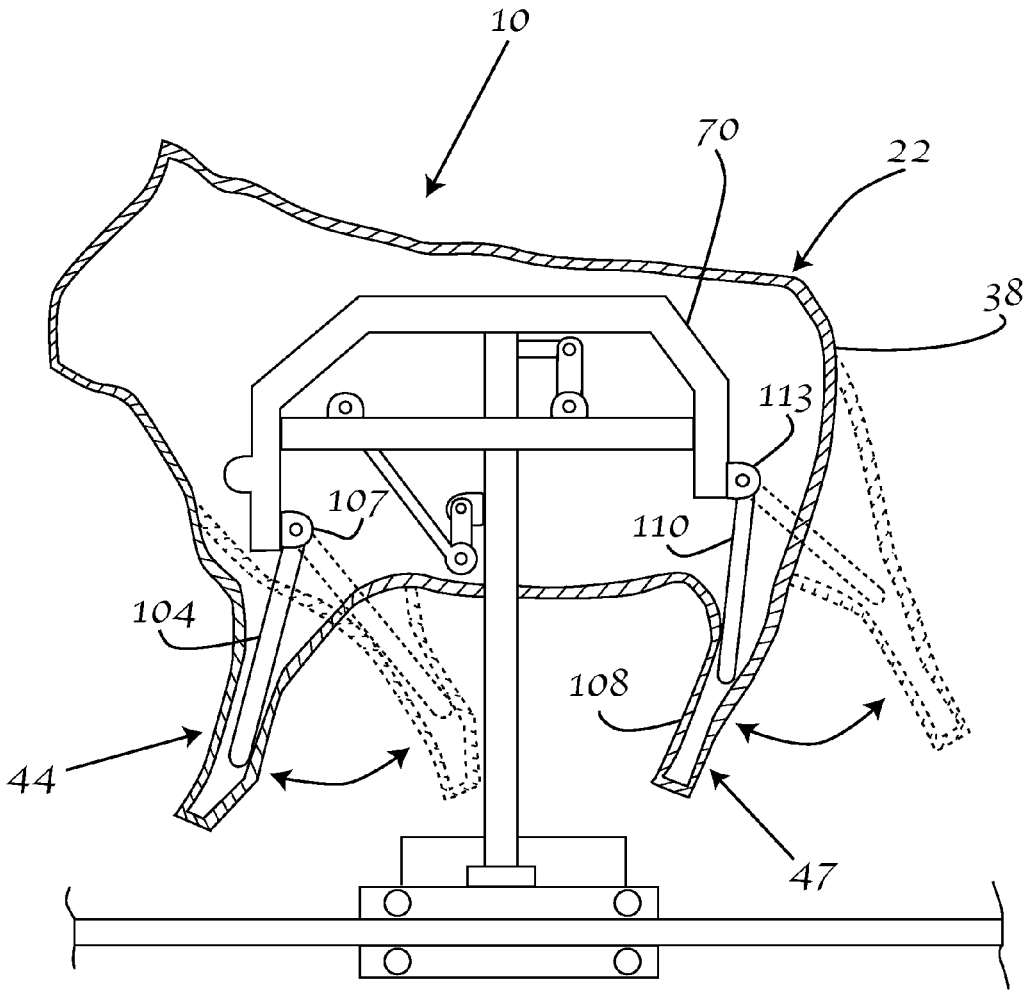
FIG. 4 is a cross-sectional view of one embodiment of the mechanical animal ride and shows the leg movements.
Figure 8:
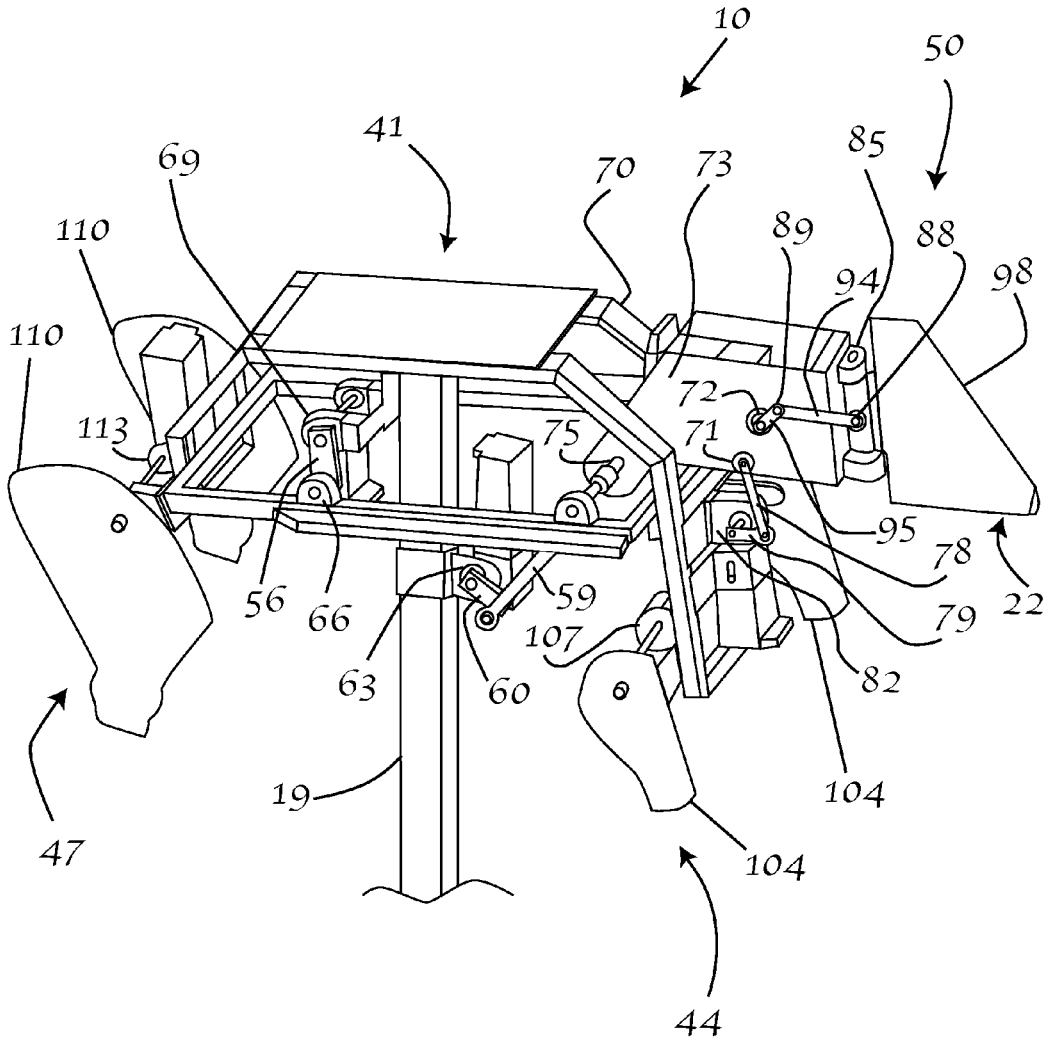
FIG. 8 is a perspective view of one embodiment of the mechanical animal ride.

FIG. 4 is a cross-sectional view of one embodiment of the mechanical animal ride and shows the leg movements. The leg portions of the animal ride 10 preferably include front legs 44 and rear legs 47. As shown in FIG. 4, the front legs 44 typically include a front leg armatures 104 and legs front actuator 107. FIG. 4 also shows that the rear legs 47 preferably include rear leg armatures 110 and rear leg actuators 113. Although only a single rear leg and front leg are shown in the FIG. 4, it should be understood that multiple front and rear legs may be present, as shown in FIGS. 1 and 8. The front leg armatures 104 are connected to the body frame 70 of the mechanical body 22 at the front leg actuators 107. The front leg actuators 107 preferably rotate, which drives the front leg armatures 104 in a clockwise and counterclockwise swinging motion that simulates movement of the front legs of an animal. Preferably, the two front legs 44 move in opposite directions of each other when the ride 10 is in use. This gives the ride a more natural looking gate. Similarly, the rear leg armatures 110 are connected to the body frame 70 through the rear leg actuators 113. The rear leg actuators 113 operate to drive the rear leg armatures 110 to provide movement of the rear legs of the mechanical body 22. The rear legs preferably move in a counterclockwise and clockwise swinging motion to simulate the appearance of the drive and kick motion of a real bucking animal. Typically, the rear legs will move in a substantially parallel motion, but the legs may alternate their swinging.

FIG. 4 also shows how the rear legs may include a knee bend 108, which may further simulate the look of a real animal, preferably a bull, bending its knees while trying to buck off the rider. In addition to simulating bucking, the legs may also simulate running and walking.

Figure 5:
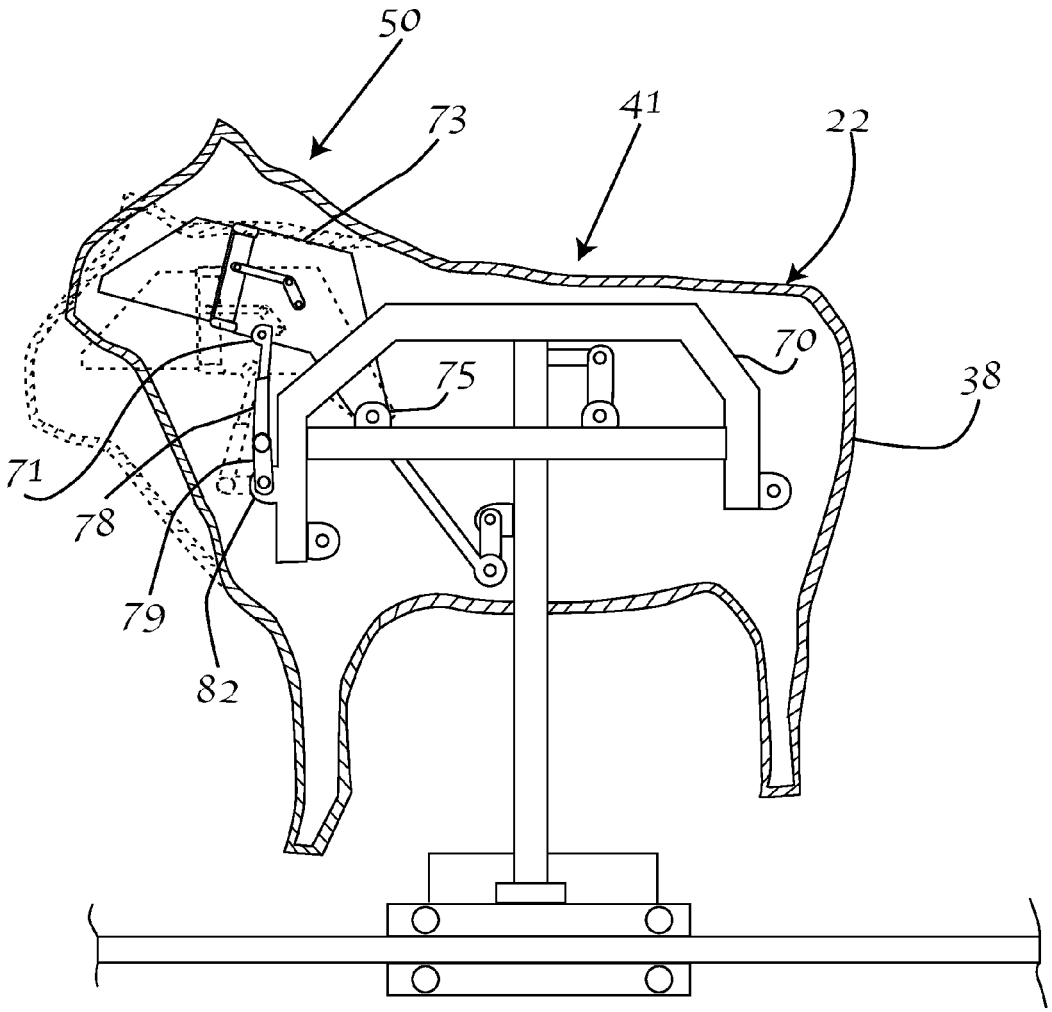
FIG. 5 is a cross-sectional view of one embodiment of the mechanical animal ride and shows the neck tilting movement.

FIG. 5 is a cross-sectional view of one embodiment of the mechanical animal ride and shows the neck tilting movement. FIG. 5 shows how the head portion 50 is attached to body portion 41 at head portion pivot point 75 and neck tilt actuator 82. The neck tilt mechanism preferably includes neck tilt armatures 78, 79, neck tilt head connection pivot 71 and neck tilt actuator 82. FIG. 5 shows how the head portion includes neck 73, which is attached to neck tilt armature 78. The neck tilt actuator 82, when operated, provides a rotary movement that causes neck armatures 78, 79 to move the neck 73 in an up and down swinging motion. Neck 73 swings up and down on head portion pivot point 75. The neck tilt actuator 82 may move clockwise or counterclockwise. The rotary movements of the neck tilt actuator 82 are preferably controlled by the electronic controller 28. The neck tilt movements of the animal ride 10 preferably simulate the up and down neck movements that a rodeo bull would make when trying to buck off a rider.

Figure 6:
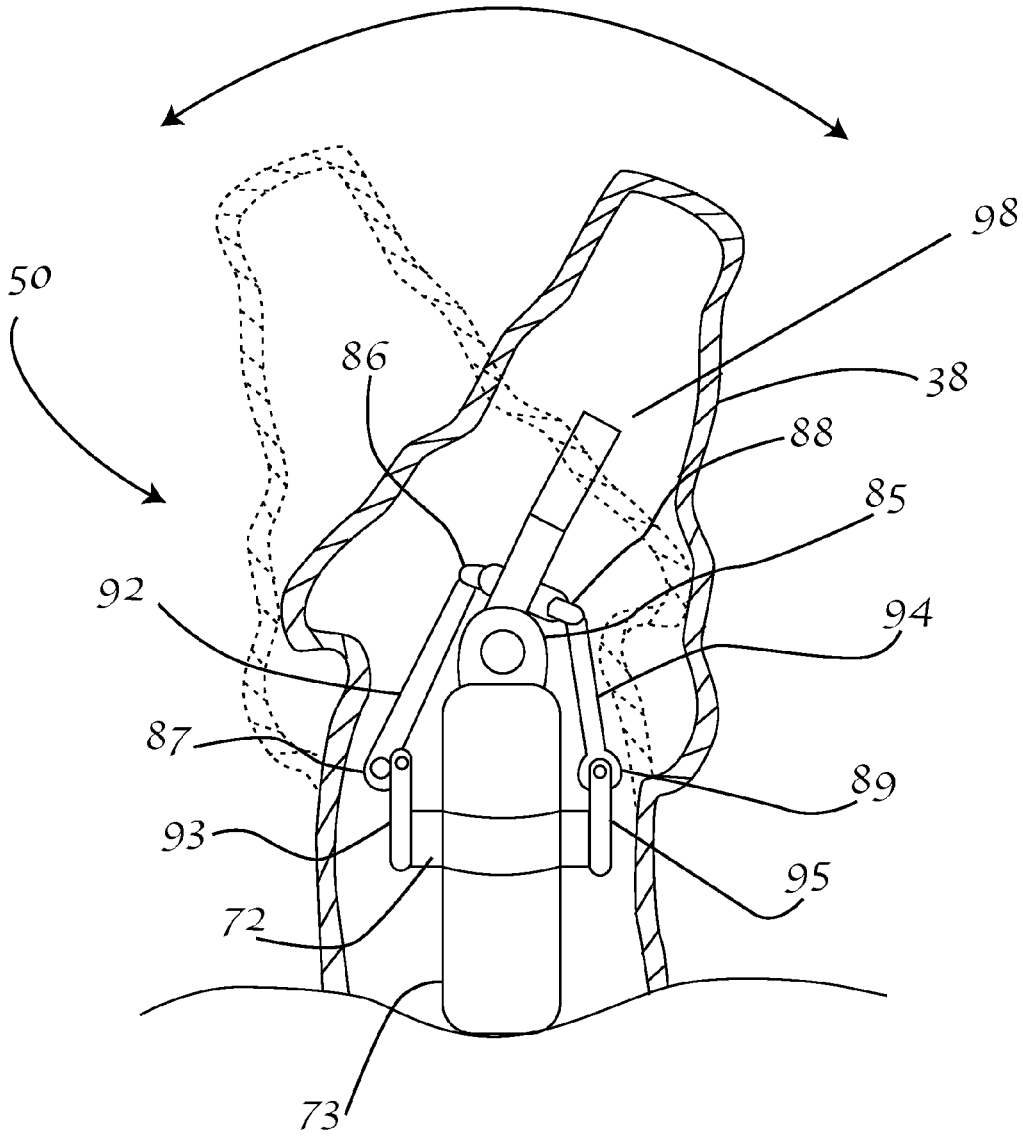
FIG. 6 is a cross-sectional view of one embodiment of the mechanical animal ride and shows the head turn movement.
Figure 7:
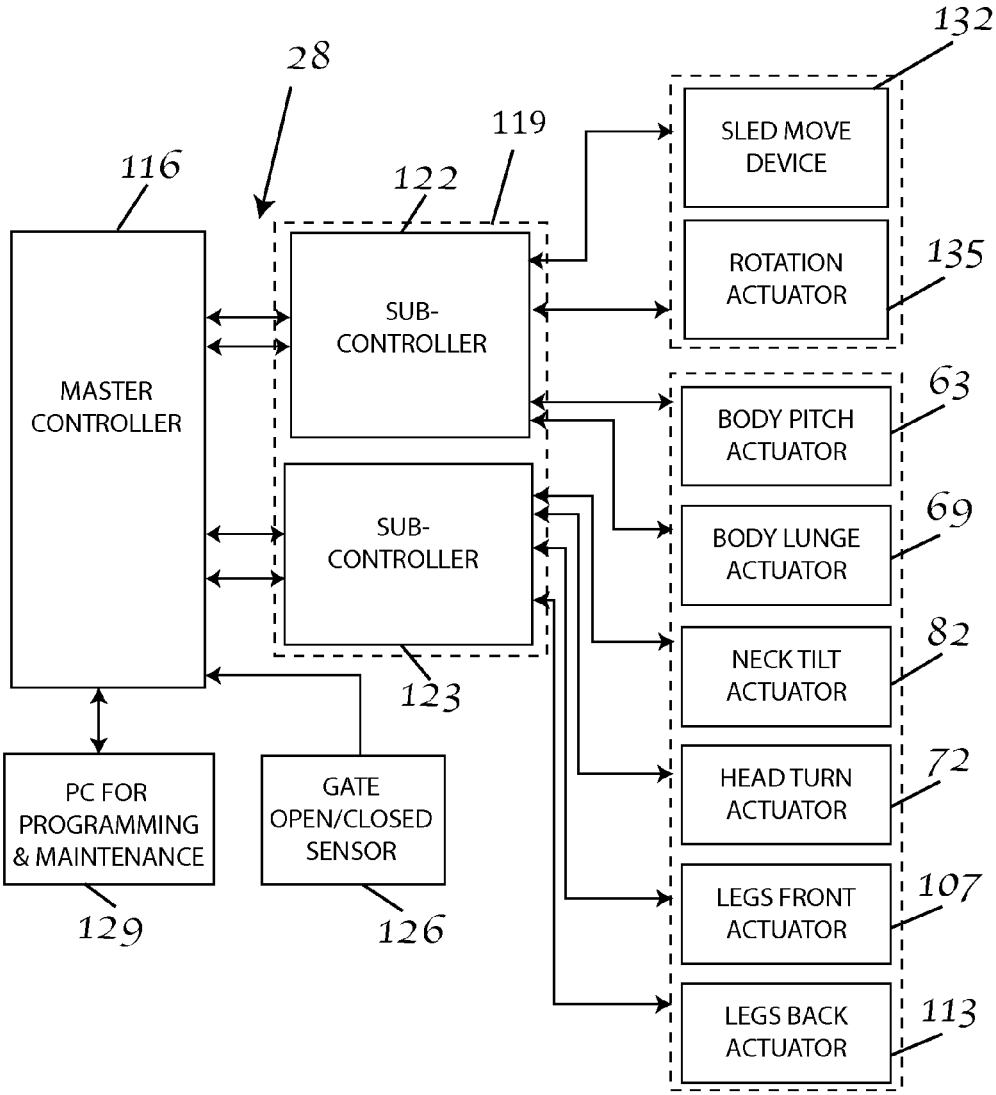
FIG. 7 is a block diagram of one embodiment of an electronic signal system for controlling the mechanical animal ride.

FIG. 6 is a cross-sectional view of one embodiment of the mechanical animal ride and shows the head turn movement. As shown in FIG. 6, the head portion 50 typically includes neck 73, head 98, head turn pivot 85, head turn actuator 72, head turn armature connection pivots 86, 87, 88, and 89, and head turn armatures 92, 93, 94, 95. The head turn actuator 72 rotates, which causes the head turn armatures 92, 93, 94, 95 to shift or shake the head 98 back and forth or left and right, with respect to neck 73 at head turn pivot 85. Although head turn armatures are shown on both sides of the head, it should be understood that the head turn mechanism may function with armatures only on one side of the head. The head turn actuator may move in either a clockwise or counterclockwise motion to turn the head left or right.

FIG. 7 is a block diagram of one embodiment of an electronic signal system for controlling the mechanical animal ride. The electronic controller 28 preferably includes a master controller 116 and may include one or more sub-controllers 119. Although FIG. 7 shows an embodiment of an electronic controller 28 including two sub-controllers 122, 123, any number of sub-controllers may be included without deviating from the scope of the invention. Additionally, the electronic controller 28 may be connected to sensors 126, which send signals to the controller when the ride chute is open so the controller may signal the actuators to operate safely. The ride 10 may also include a computer 129 for a user to interact with the electronic controller 28. The master controller 116 is preferably in electrical communication with both the mechanical body 22 and sled 16. Typically, this communication is through one or more sub-controllers 119. The controllers 116, 122, and 123 may be located remotely from the mechanical body 22 and sled 16, or they may be an integrated part of the mechanical body 22 and/or sled 16. If located remotely from the mechanical body 22 and sled 16, the controllers 116, 122, and 123 are preferably connected to the sled 16 and/or mechanical body 22 through a plurality of wires that provide the signals. The wires would preferably provide power to the sled 16, mechanical body 22, and the various actuators within the sled and mechanical body.

FIG. 7 shows how the mechanical body 22 and sled 16 actuators, including body pitch actuator 63, body lunge actuator 69, head turn actuator 72, neck tilt actuator 82, sled move device 132, and rotation actuator 135, are controlled by controller 28. Preferably the master controller 116 and sub-controllers 122 and 123 are programmed to provide synergistic commands to the various actuators so they work in concert to provide a rider with a unique and realistic bull ride experience. Moreover, the controller 28 may be programmed so that each ride experiences a different combination of lunges, pitches, turns, rotations, and tilts. In this manner, each ride will be unique and different from any previous ride done on the animal ride 10.

FIG. 8 is a perspective view of one embodiment of the mechanical animal ride. As shown in FIG. 8, the mechanical animal ride 10 preferably includes: the mechanical body 22; front leg portions 44; rear leg portions 47; head portion 50; body portion 41; support mount 19; lunge armature 56; head turn armature connection pivots 88, 89; drive pitch armatures 59, 60; body pitch actuator 63; lunge rotation point 66; body lunge actuator 69; body frame 70; neck 73; head portion pivot point 75; head 98; head turn pivot 85; head turn actuator 72; head turn armatures 94, 95; neck tilt armatures 78, 79; neck tilt head connection pivot 71; neck tilt actuator 82; front leg armatures 104; front leg actuators 107; rear leg armatures 110; and back leg actuators 113.

The mechanical body 22 may include a breathing apparatus to replicate breathing movements similar to a live rodeo animal. Specifically, the mechanical body may include one or more inflatable bags or actuators located substantially near the head portion 50 that inflate or activate upon a command from the master controller 116 or other control unit device.

The mechanical body 22 may include an apparatus to provide scents similar to a live rodeo animal. Specifically, the mechanical body 22 may include one or more scent dispensers located anywhere in the mechanical body 22 to produce scents similar to a rodeo animal. Alternatively, the one or more scent dispensers may be located anywhere outside the mechanical body 22, such as on the track 13, sled 16, chute, or other location within the ride arena. The scent dispenser may be activated by the master controller 116 or any type of control device device.

The mechanical body 22 may include an audio device to produce sounds similar to a live rodeo animal or other sounds of the rodeo. Specifically, the mechanical body may include one or more speakers located substantially near the head portion 50 of the mechanical body 22, wherein the speakers are connected to the master controller 116. While the one or more speakers are preferably located near the head portion 50 of the mechanical body 22, the one or more speakers may be located anywhere in the mechanical body or anywhere within the rodeo arena without deviating from the scope of the invention. Although the master controller 116 may be used to activate the rodeo bull sounds, any controlling device may be used to activate the speakers to produce the sounds.

The foregoing description of the preferred embodiment of the invention has been presented for the purposes of illustration and description. While multiple embodiments are disclosed, still other embodiments of the present invention will become apparent to those skilled in the art from the above detailed description, which shows and describes illustrative embodiments of the invention. As will be realized, the invention is capable of modifications in various obvious aspects, all without departing from the spirit and scope of the present invention. Accordingly, the detailed description is to be regarded as illustrative in nature and not restrictive. Also, although not explicitly recited, one or more embodiments of the invention may be practiced in combination or conjunction with one another. Furthermore, the reference or non-reference to a particular embodiment of the invention shall not be interpreted to limit the scope the invention. It is intended that the scope of the invention not be limited by this detailed description, but by the claims and the equivalents to the claims that are appended hereto.

Except as stated immediately above, nothing which has been stated or illustrated is intended or should be interpreted to cause a dedication of any component, feature, object, benefit, advantage, or equivalent to the public, regardless of whether it is or is not recited in the claims.

What is claimed is:

1. A mechanical device for simulating an animal ride, comprising:

a track;

a sled;

a support mount;

a mechanical body, wherein said mechanical body is comprised of one or more actuators; and one or more controllers;

wherein said sled is movably connected to said track;

wherein said support mount is attached to said sled, such that said support mount rises upward from a top portion of said sled;

wherein said mechanical body is connected to said support mount, such that said mechanical body is positioned above said sled;

wherein said mechanical body is mounted by a rider;

wherein said one or more controllers communicate electrical signals to said one or more actuators to cause said one or more actuators to simulate one or more movements of an animal; and wherein said sled moves along said track when said actuators simulate said one or more movements of said animal;

wherein said support mount is rotatable with respect to said sled;

wherein said mechanical body anatomically simulates said animal;

wherein said mechanical body is further comprised of an outer skin layer;

wherein said outer skin layer causes said mechanical body to visually resemble said animal;

wherein said sled is further comprised of a plurality of wheels;

wherein said plurality of wheels matingly engage with said track and wherein said plurality of wheels move said sled along said track;

wherein said sled is further comprised of a rotational actuator that rotates said support mount with respect to said sled.

2. The mechanical device for simulating an animal ride of claim 1, wherein said mechanical body is further comprised of a head portion, a trunk portion, and one or more leg portions.

3. The mechanical device for simulating an animal ride of claim 2, wherein said head portion and said one or more leg portions are moveably connected to said trunk portion.

4. The mechanical device for simulating an animal ride of claim 3, wherein said one or more actuators are comprised of one or more neck tilt actuators.

5. The mechanical device for simulating an animal ride of claim 4, wherein said one or more neck tilt actuators are connected to said trunk portion and said head portion;

wherein said one or more neck tilt actuators move said head portion up and down with respect to said trunk portion.

6. The mechanical device for simulating an animal ride of claim 5, wherein said one or more actuators are further comprised of one or more head turn actuators.

7. The mechanical device for simulating an animal ride of claim 6, wherein said one or more head turn actuators are located on said head portion;

wherein said one or more head turn actuators move said head portion back and forth.

8. The mechanical device for simulating an animal ride of claim 7, wherein said one or more actuators are comprised of one or more leg actuators.

9. The mechanical device for simulating an animal ride of claim 8, wherein said one or more leg actuators are connected to said trunk portion and said one or more leg portions;

wherein said one or more leg actuators pivot said one or more leg portions back and forth with respect to said trunk portion.

10. The mechanical device for simulating an animal ride of claim 9, wherein said one or more actuators are further comprised of one or more body pitch actuators and one or more lunge actuators.

11. The mechanical device for simulating an animal ride of claim 10, wherein said one or more body pitch actuators are located substantially near a center of said mechanical body and provide one or more pitching movements of said mechanical body;

wherein said one or more lunge actuators are located adjacent to a rear side of said support mount and provide one or more lunging movements of said mechanical body.

12. The mechanical device for simulating an animal ride of claim 11, further comprising a safety harness; wherein said safety harness prevents said rider from being thrown from said mechanical body.

13. A mechanical device for simulating an animal ride, comprising:

a track;

a sled;

a support mount;

a mechanical body, wherein said mechanical body is comprised of one or more actuators, an out skin layer, a head portion, a trunk portion, and one or more leg portions;

one or more controllers; and a safety harness;

wherein said sled is movably connected to said track;

wherein said support mount is attached to said sled, such that said support mount rises upward from a top portion of said sled;

wherein said mechanical body is connected to said support mount, such that said mechanical body is positioned above said sled;

wherein said mechanical body is mounted by a rider;

wherein said one or more controllers communicate electrical signals to said one or more actuators to cause said one or more actuators to simulate one or more movements of a rodeo bull;

wherein said sled moves along said track when said actuators simulate said one or more movements of said rodeo bull;

wherein said sled is further comprised of a rotational actuator that rotates said support mount with respect to said sled;

wherein said mechanical body anatomically simulates said rodeo bull;

wherein said outer skin layer causes said mechanical body to visually resemble said rodeo bull;

wherein said sled is further comprised of a plurality of wheels;

wherein said plurality of wheels matingly engage with said track and wherein said plurality of wheels move said sled along said track;

wherein said head portion and said one or more leg portions are moveably connected to said trunk portion;

wherein said one or more actuators are comprised of one or more neck tilt actuators, one or more head turn actuators, one or more leg actuators, one or more body pitch actuators, and one or more lunge actuators;

wherein said one or more neck tilt actuators are connected to said trunk portion and said head portion;

wherein said one or more neck tilt actuators move said head portion up and down with respect to said trunk portion;

wherein said one or more head turn actuators are located on said head portion;

wherein said one or more head turn actuators move said head portion back and forth;

wherein said one or more leg actuators are connected to said trunk portion and said one or more leg portions;

wherein said one or more leg actuators pivot said one or more leg portions back and forth with respect to said trunk portion;

wherein said one or more body pitch actuators are located substantially near a center of said mechanical body and provide one or more pitching movements of said mechanical body;

wherein said one or more lunge actuators are located adjacent to a rear side of said support mount and provide one or more lunging movements of said mechanical body;

wherein said safety harness is comprised of a padded safety vest and wherein said safety harness prevents said rider from being thrown from said mechanical body.

14. A mechanical device for simulating a bull ride ride, comprising:

a track;

a wheeled sled;

a support mount;

a mechanical body, wherein said mechanical body is comprised of one or more actuators, an out skin layer, a head portion, a trunk portion, and one or more leg portions;

wherein said wheeled sled is movably connected to said track such that said sled moves along a length of said track;

wherein said support mount is attached to said sled, such that said support mount rises upward from a top portion of said sled;

wherein said mechanical body is connected to said support mount, such that said mechanical body is positioned above said sled;

wherein said one or more actuators simulate one or more movements of a rodeo bull;

wherein said sled moves along said track when said actuators simulate said one or more movements of said rodeo bull;

wherein said sled is further comprised of a rotational actuator that rotates said support mount with respect to said sled;

wherein said mechanical body anatomically simulates said rodeo bull;

wherein said outer skin layer causes said mechanical body to visually resemble said rodeo bull;

wherein said head portion and said one or more leg portions are moveably connected to said trunk portion;

wherein said one or more actuators are comprised of one or more neck tilt actuators, one or more head turn actuators, one or more leg actuators, one or more body pitch actuators, and one or more lunge actuators;

wherein said one or more neck tilt actuators are connected to said trunk portion and said head portion;

wherein said one or more neck tilt actuators move said head portion up and down with respect to said trunk portion;

wherein said one or more head turn actuators are located on said head portion;

wherein said one or more head turn actuators move said head portion back and forth;

wherein said one or more leg actuators are connected to said trunk portion;

wherein said one or more leg actuators pivot said one or more leg portions back and forth with respect to said trunk portion;

wherein said one or more body pitch actuators are located substantially near a center of said mechanical body and provide one or more pitching movements of said mechanical body;

wherein said one or more lunge actuators are located adjacent to a rear side of said support mount and provide one or more lunging movements of said mechanical body.

* * * * *